United States Patent [19]

Johnson

[11] 4,083,217

[45] Apr. 11, 1978

[54] OVERLAPPING GEAR DRIVE FOR STRAIGHTENING MACHINES

[75] Inventor: Kenneth C. Johnson, Des Plaines, Ill.

[73] Assignee: F. J. Littell Machine Company, Chicago, Ill.

[21] Appl. No.: 774,810

[22] Filed: Mar. 7, 1977

[51] Int. Cl.[2] ..... B21D 1/02

[52] U.S. Cl. ..... 72/165; 72/249

[58] Field of Search ..... 72/165, 160, 163, 164, 72/249

[56] References Cited

U.S. PATENT DOCUMENTS

| | | | |
|---|---|---|---|
| 636,912 | 11/1899 | Mergenthaler | 72/165 X |
| 712,300 | 10/1902 | Huston | 72/165 |
| 2,742,949 | 4/1956 | Nilsson | 72/165 X |
| 3,383,898 | 5/1968 | Properzi | 72/249 |
| 3,546,915 | 12/1970 | Severin et al. | 72/249 |

*Primary Examiner*—Milton S. Mehr
*Attorney, Agent, or Firm*—Russell H. Clark

[57] ABSTRACT

The invention relates to a train of gears housed within a gear box and designed for driving the lower straightening rolls of a feeding and straightening machine. The gears in the gear box are disposed in staggered relation in adjacent parallel planes and each drive gear is journalled by a drive shaft having a coupling connection to a straightening roll. The staggered arrangement of the drive gears is an important feature since the drive gears have pitch diameters greater than the center to center distance between adjacent straightening rolls. In addition to staggering the drive gears the invention provides idler gears which are interposed between adjacent drive gears, with one idler gear in one plane receiving the drive and the other idler gear in the adjacent parallel plane transmitting the drive.

6 Claims, 8 Drawing Figures

OVERLAPPING GEAR DRIVE FOR STRAIGHTENING MACHINES

Figure 1:
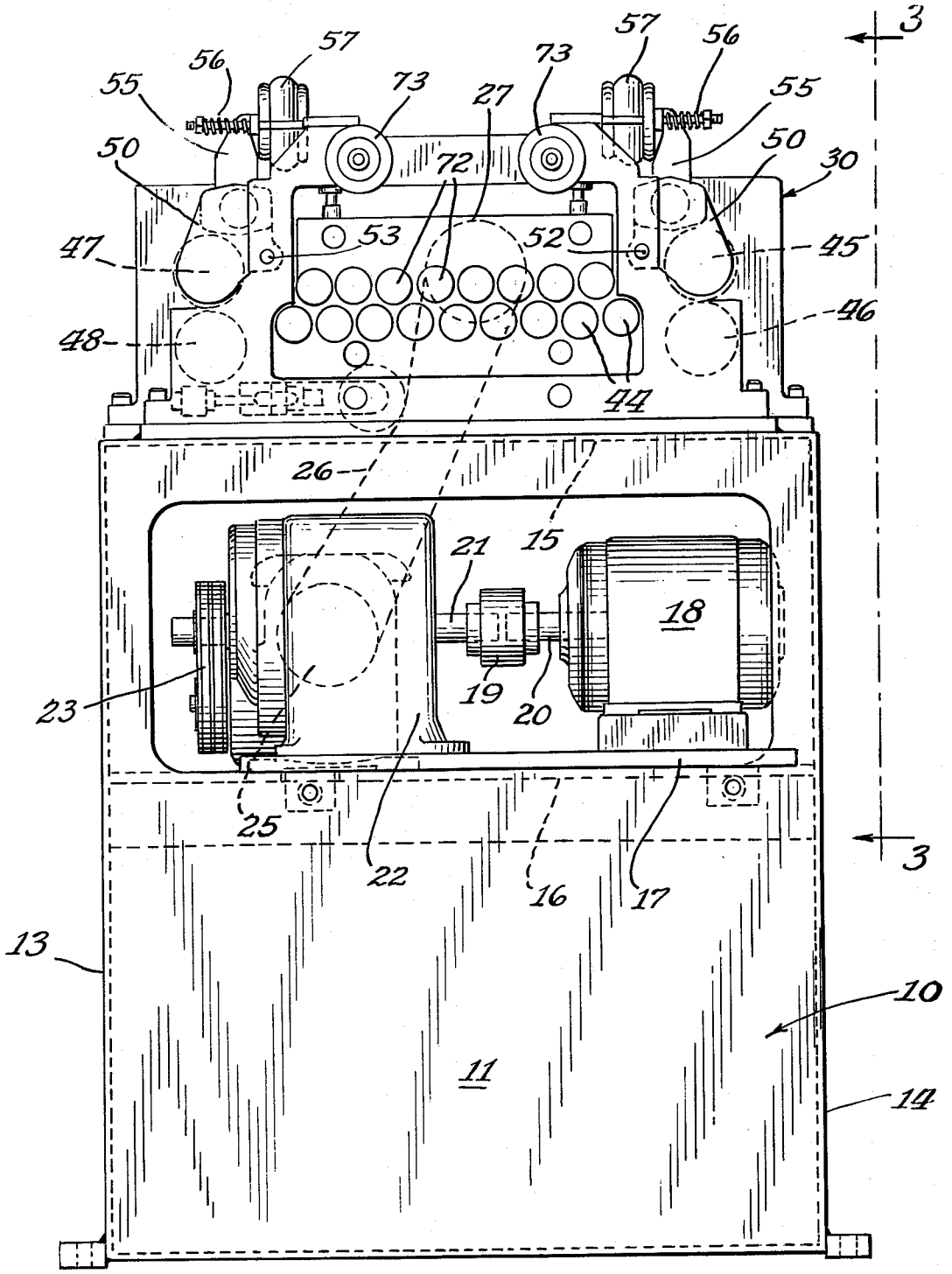

The invention relates to a train of gears for driving the lower straightening rolls of a feeding and straightening machine and has reference in particular to a gear drive for the lower rolls of such a machine wherein the gears will have pitch diameters somewhat greater than the center to center distance between rolls.

The invention seeks to provide means for more effectively transmitting the high torque generally present in such straightening machines during their normal operation and especially those machines having lower rolls on relatively close centers such as two to four inch centers. Since the distance between centers is the controlling factor limiting the pitch diameter of the drive gears, it necessarily follows that the gear train is made up of relatively small gears. When such gears are employed for driving small rolls on close centers, the result is materially limited horsepower capacity. The gear drive of the present invention contemplates the use of gears having pitch diameters greater than the center to center distance between straightening rolls and thus as a result of the larger gears the horsepower capacity is materially increased. It follows that the lead placed on the rolls can also be increased.

Another objective of the present invention resides in the provision of a gear drive for straightening machines wherein the gears for driving the lower straightening rolls have overlapping relation and which is made possible by staggering the gears in adjacent parallel planes.

Another object contemplated by the invention is to provide a gear drive for the lower rolls of a straightening machine having the gears thereof located in staggered relation in adjacent parallel planes so that the pitch diameter of the gears may exceed the distance between roll centers and wherein idler gears provided with a pair of gear faces are employed, with one gear face receiving the drive in one plane and the other gear face transmitting the drive in the other plane.

Another object of the invention is to provide a gear drive of the character described for driving the lower rolls only of a straightening machine and thus by driving only the lower straightening rolls, extra transmission parts can be eliminated for greater ecomony without sacrificing the efficiency of the equipment.

A further objective is to provide a gear drive of the character described for driving the lower rolls of a straightening machine and wherein the shafts for the upper pinch rolls are operatively connected to their respective driving gears by an improved form of an offset radial drive coupling which permits up and down bodily movement of the rotating pinch rolls while eliminating the more expensive and less efficient universal joint and shafting equipment as heretofore employed.

With these and other objects in view, the invention may consist of certain novel features of construction and operation as will be more fully described and particularly pointed out in the drawings, specification and claims appended hereto.

Figure 2:
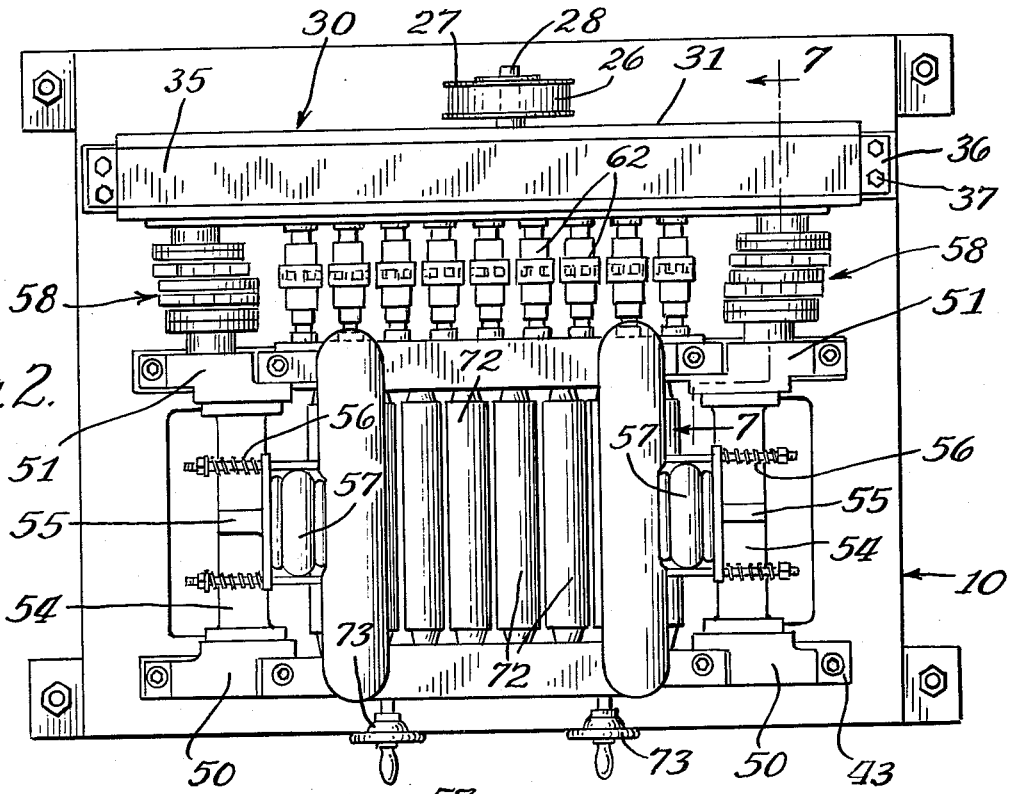
Figure 3:
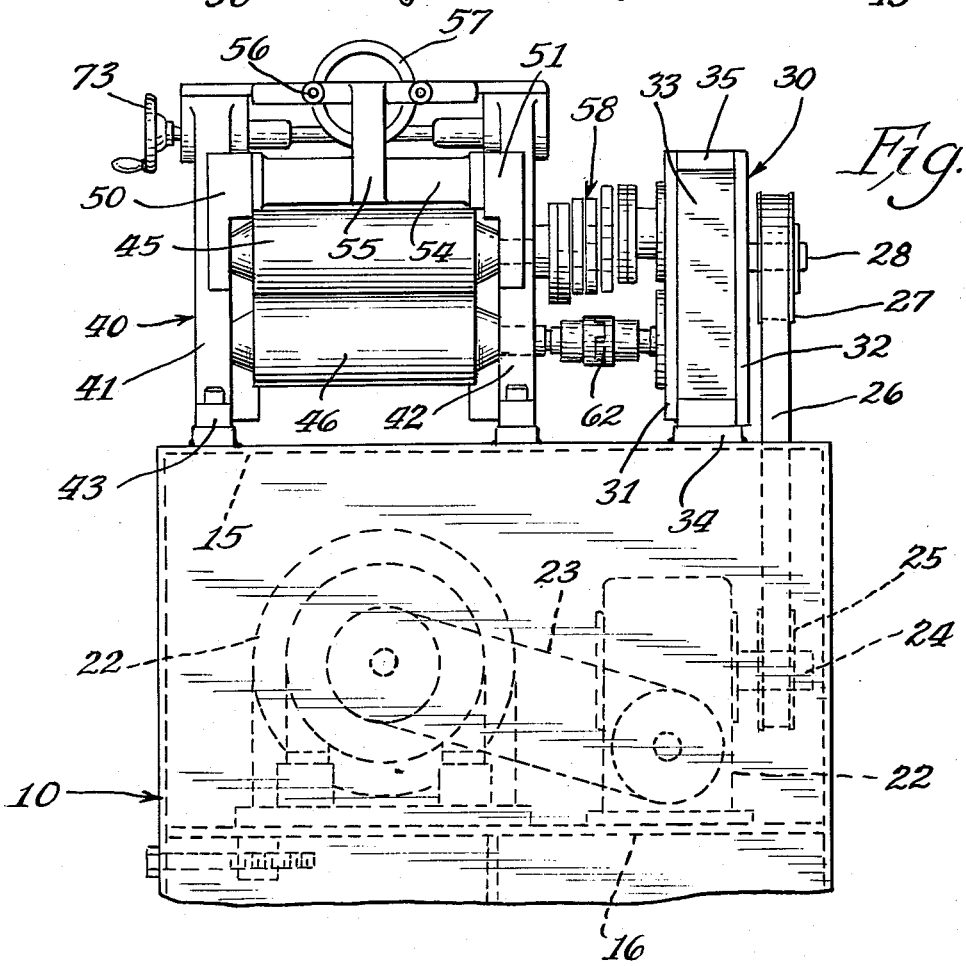
Figure 4:
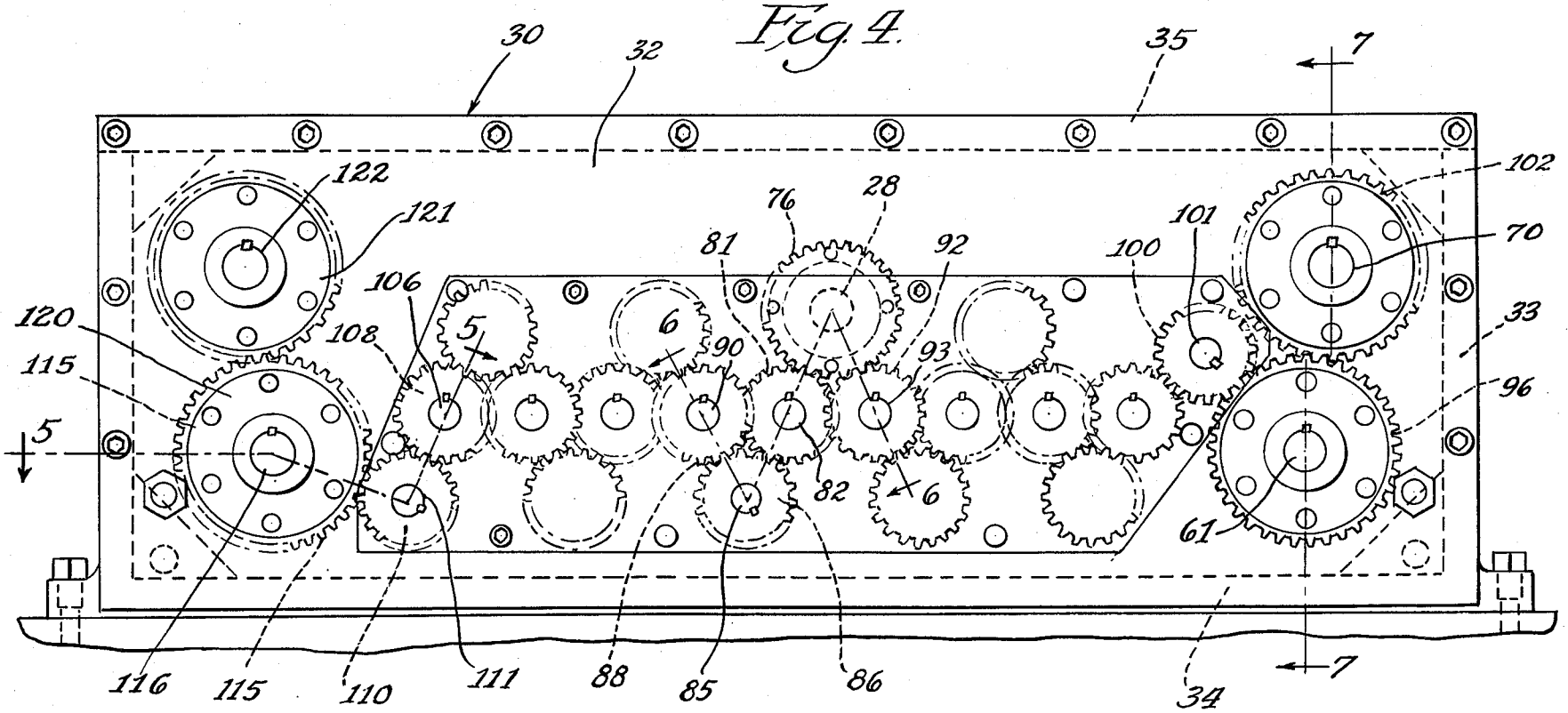
Figure 5:
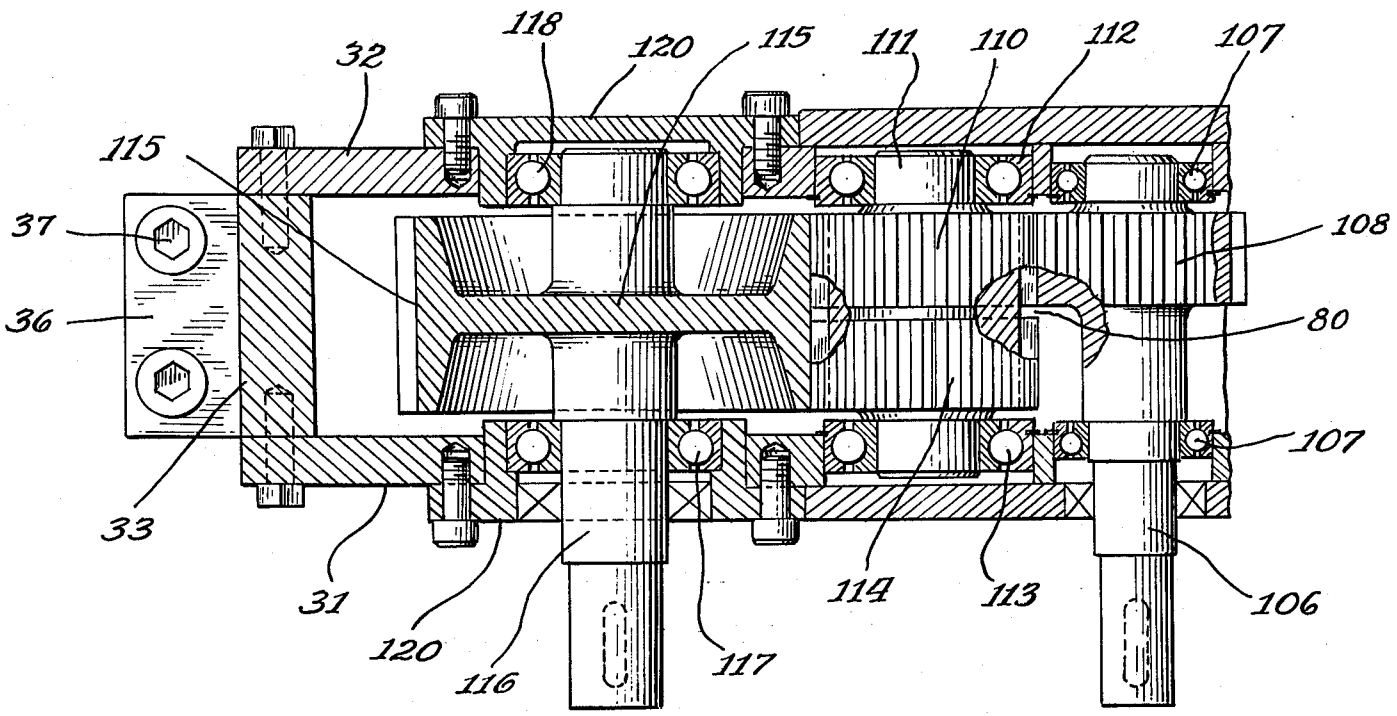
Figure 6:
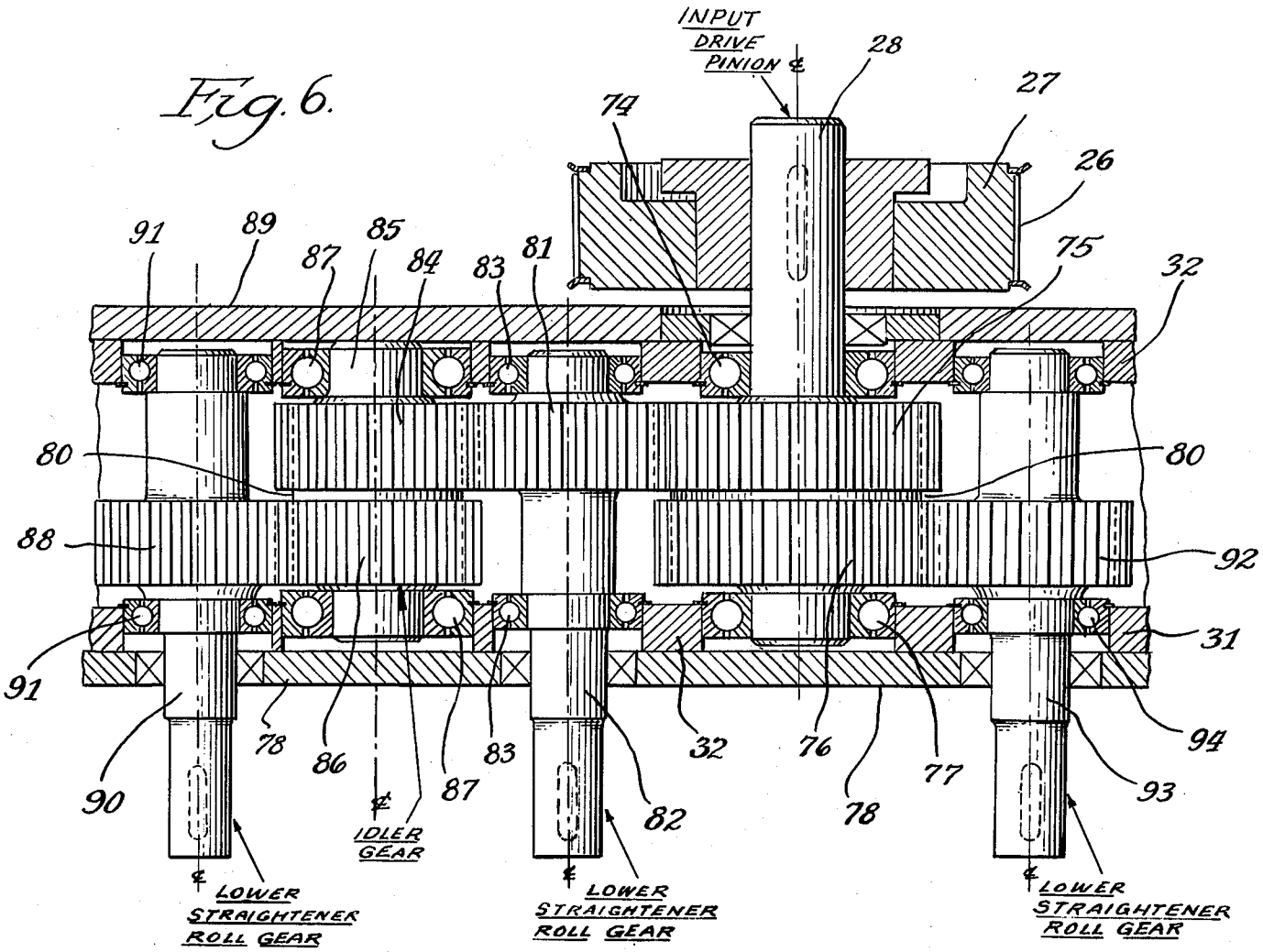
Figure 7:
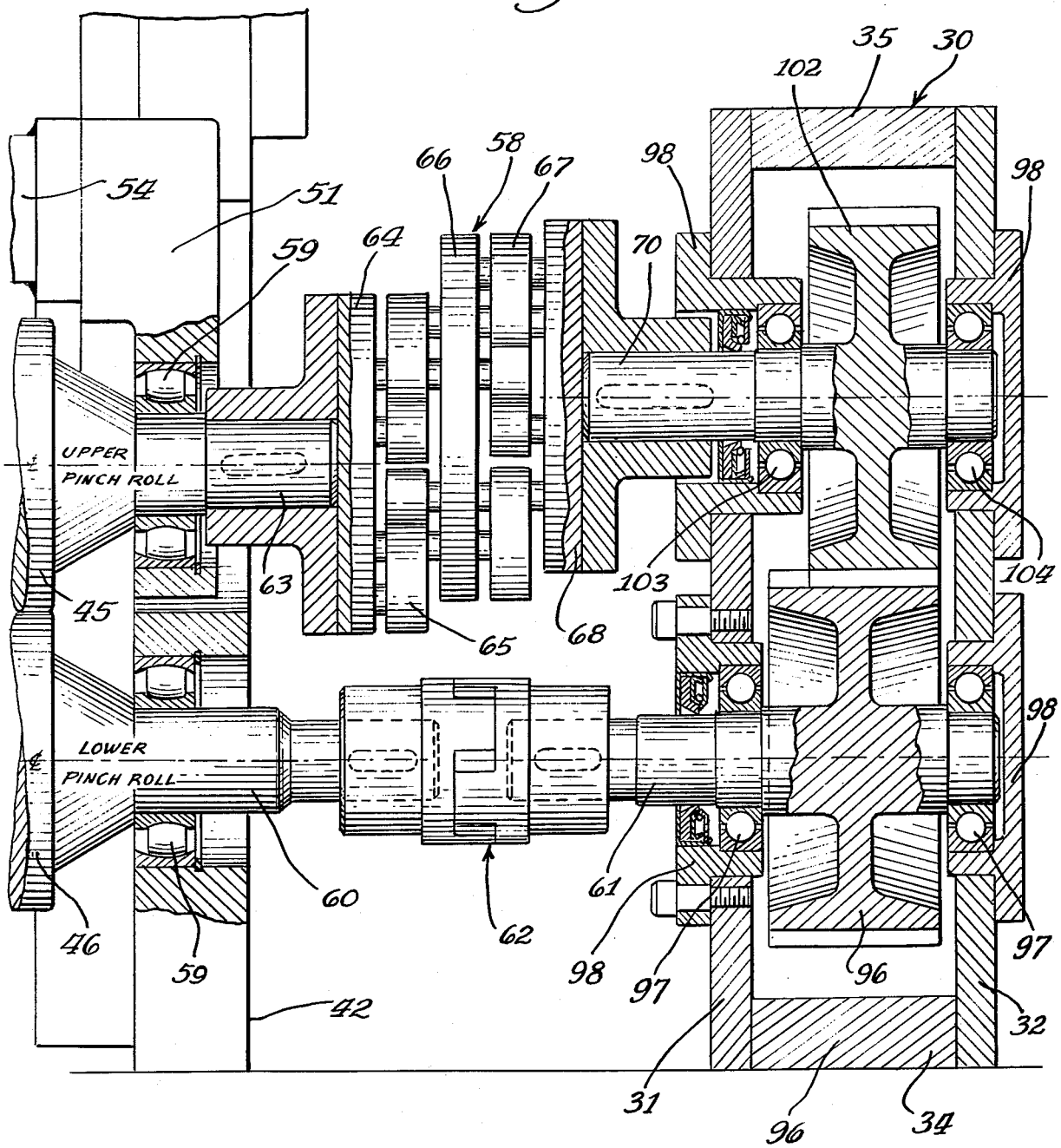
Figure 8:
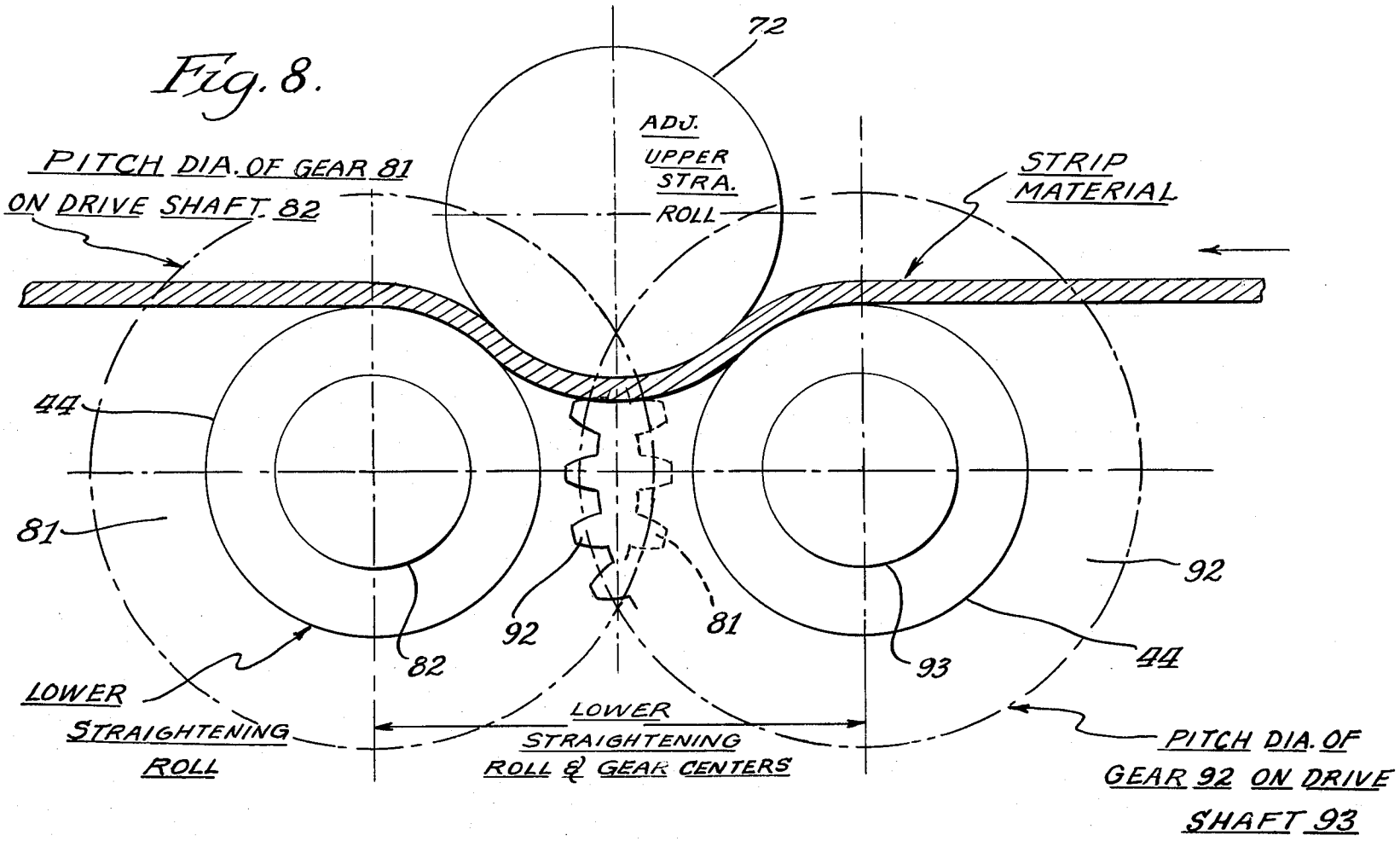

In the drawings which illustrate an embodiment of the invention and wherein like reference characters are used to designate like parts, FIG. 1 is a side elevational view of a complete power driven straightening and feeding apparatus incorporating the novel and improved overlapping gear drive of the invention, FIG. 2 is a top plan view looking down on the gear box, the straightening machine and the connecting couplings which operatively connect the drive shafts of the gear box with the respective rolls of the straightening machine, FIG. 3 is a rear elevational view of the straightening machine of FIG. 1 taken on line 3—3 and showing the connecting couplings for the upper and lower pinch rolls respectively, FIG. 4 is a side elevational view showing in greater detail and on an enlarged scale the gear box with the overlapping gear drive of the invention, FIG. 5 is a transverse sectional view taken substantially on line 5—5 of FIG. 4, FIG. 6 is a transverse sectional view taken substantially on line 6—6 of FIG. 4, FIG. 7 is a transverse sectional view taken substantially on line 7—7 of FIG. 4 and showing on an enlarged scale the offset radial drive coupling for one of the upper bodily movable pinch rolls and also showing the coupling for the lower pinch roll, and FIG. 8 is a view on an enlarged scale illustrating the overlapping relation of adjacent gears for two of the lower straightening rolls which rotate but which do not move bodily, and further showing an upper adjustable roll for coaction with the lower rolls to perform a straightening operation on strip material.

Referring to the drawings and in particular to FIGS. 1, 2 and 3, the complete assembly for illustrating the present invention includes a base supporting frame 10 of box like formation and which is formed by side walls 11 and 12, end walls 13 and 14, a top wall 15 and an intermediate wall 16. The intermediate wall 16 supports the base plate 17 on which is suitably mounted the electric drive motor 18 providing the drive shaft 20 connected by the coupling 19 to the drive shaft 21 of speed reducing units 22 operatively connected by the endless belt 23. The output drive shaft 24 carries the pulley 25 which receives the endless belt 26 having driving relationship with the pulley 27 on drive shaft 28 of the gear box. Said gear box contains the overlapping gear drive of the invention and the same is formed by the rectangular side walls 31 and 32, the end members 33, a base wall 34 and a top wall 35. The projecting feet 36 of the gear box are secured by the bolts 37 to the top wall 15 of the supporting base 10.

The gear drive enclosed within the gear box 30 is operatively connected by coupling means, shown in FIGS. 3 and 7, with the pinch rolls and lower straightening rolls of a feeding and straightening machine generally designated by numeral 40. Said machine is conventional in construction and in operation and is substantially similar to the straightening machine shown in U.S. Pat. No. 3,289,448 granted to C. Wiig on Dec. 6, 1966.

For purposes of the present invention it is necessary to understand that the straightening machine includes a pair of side walls 41 and 42 having foot pads 43 by which the side walls are securely fastened to the top wall 15. The side walls journal a plurality of lower straightening rolls 44, and also journal a pair of of pinch rolls at respective ends namely 45, 46 and 47, 48, best shown in FIG. 1. The lower straightening rolls 44 and the pinch rolls 46 and 48 are journalled for rotation in a conventional manner and the shaft for each roll extends through wall 42, FIG. 3, for receiving the coupling 62 for operative connection to the gear box drive shaft for the same as will be presently described in detail. The upper pinch rolls 45 and 47 have bodily up and down movement in addition to having rotation and the shaft of each upper roll is suitably journalled in spaced pivotally mounted members 50 and 51 being pivotally supported for such movement at 52, FIG. 1, for the pinch roll 45 at the entrance end and at 53 for pinch roll 47 at the exit end. Each pair of members 50 and 51 extend upwardly for connection by the cross tube 54, as shown in FIG. 3, which provides the center member 55 having operative connection with the coil springs 56 which yieldingly and releasably hold the center member in contact with the air bag 57. Since each of the upper pinch rolls 45 and 47 have up and down bodily movement in addition to being driven, it is necessary to provide a special type of coupling unit, namely an offset radial drive coupling indicated in its entirety by numeral 58. Said coupling joins the shaft of its pinch roll with its particular drive shaft provided by the gear box 30. The couplings 58 are know as Schmidt couplings and are manufactured by the Tool Steel Gear and Pinion Co. of Cincinnati, Ohio.

Thus as shown in FIG. 7, the lower pinch roll 46 has its shaft 60 journalled by the bearing 59 in side wall 42 and the shaft extends beyond for receiving the coupling 62, which joins shaft 60 with shaft 61 extending from the gear box. The upper pinch roll 45 is journalled in the pivotal members 50, 51 by bearing units similar to 59 and the extending shaft 63 of the same receives the coupling member 64 of the offset radial drive coupling 58, the same being keyed thereto. The coupling member 64 has pivotally secured thereto a plurality of links 65 which are similarly pivotally secured to an intermediate coupling member 66. On the right hand side of member 66 the links 67 are similar to links 65 and the same are in turn pivotally secured to the coupling member 68 mounted on and keyed to its drive shaft 70 which projects from the gear box 30. In addition to the lower straightening rolls 44, a conventional straightening machine includes a plurality of upper rolls 72 and which are bodily movable towards and from the lower rolls for threading purposes and for increasing or decreasing the bending and the straightening effect of the rolls, see FIG. 8. Said upper rolls can be adjusted vertically as a unit by the hand wheels 73.

The main objective of the invention is to provide a gear drive for the lower rolls including the rolls 44, the lower pinch rolls 46 and 48 and also the upper bodily movable pinch rolls 45 and 47, and wherein some of the gears will overlap having pitch diameters somewhat greater than the center distance between rolls. The gear drive as contemplated is shown in FIGS. 4, 5 and 6. The input drive shaft 28, FIG. 6, enters the gear box 30 through the side wall 32 and said shaft is journalled in such wall by the bearing unit 74. Inside the box the shaft has the gear 75 mounted thereon in keyed relation as is also the companion gear 76. The end of the shaft 28 beyond the gear 76 is journalled by the bearing unit 77 located in wall 31. The closure plate 78 effectively seals the space occupied by the shaft and bearing unit. The gears 75 and 76 may be formed as one gear with a groove such as 80 formed therein or two separate gears may be employed. The two gears thus lie in different parallel planes which are adjacent each other. Gear 75 drives in a direction to the left, FIG. 6, and gear 76 drives in a direction to the right.

First of all, tracing the drive of gear 75 it will be seen that is meshes with a gear 81 on the drive shaft 82 for one of the lower straightening rolls 44. Said shaft is connected to its lower roll by a coupling such as 62 previously described. Shaft 82 is journalled in walls 31 and 32 by the bearing units 83. Gear 81 in turn meshes with an idler gear 84 on the idler shaft 85, which shaft also mounts the idler gear 86. The idler shaft is journalled in walls 31 and 32 of the gear box 30 by the bearing units 87 and here again the two gears on shaft 85 may be separate or one single unit divided by the groove 80. The closure plate 78 is similar to that as described. The drive from gear 75 to gear 81, to gear 84 is transferred by the idler shaft 85 to gear 86 which meshes with gear 88 on another drive shaft 90 for another one of the lower straightening rolls. Shaft 90 is journalled by the bearing units 91 and the unit in wall 32 in addition to the bearings 87 and 83 are suitably covered by the closure plate 89. Tracing the drive from shaft 28 to the right it will be seen that the gear 76 meshes with a gear 92 on another drive shaft 93 for another one of the lower straightening rolls 44. Shaft 93 is journalled in walls 31 and 32 by the bearing units 94.

The arrangement of gears on the driving shafts for the lower straightening rolls together with the interpositioning of the idler gears both right an left from the input shaft 28 until the large gears for driving the pinch rolls are reached. All the gears and the drive shafts for the lower straightening rolls are driven at the same speed and in the same direction. For example if the gear 76 rotates counter-clockwise then gear 92 will rotate clockwise and also with gear 75 rotating counter-clockwise the gear 81 will rotate clockwise. FIGS. 4 and 8. Also due to the interpositioning of the idler gears the drive shaft 90 and the other remaining drive shafts will also rotate in a clockwise direction. It will be seen from the said figures that gears 92 and 88 overlap gear 81. The overlapping is necessary since the pitch diameter of the gears is greater than the center to center distance between the lower drive shafts. Gear 92 for driving shaft 93 lies in one plane whereas gear 81 for driving the adjacent shaft 82 lies in a different plane but which is adjacent and parallel. Gear 88 for shaft 90 has the same relationship to gear 81. This staggered arrangement of the driving gears for driving the lower straightening rolls makes possible the larger pitch diameters of the same. As previously stated, the horse power capacity of the straightening machine is materially increased by the larger driving gears.

The pinch rolls at the receiving end of the machine are indicated by numerals 45 and 46 since the strip materal moves from right to left. Thus drive shaft 61 FIG. 7, carries the large gear 96 and said shaft is journalled in bearing units 97 located in the side walls 31 and 32. Cap plates 98 are associated with the bearing unit in wall 31 and also with the unit in wall 32. The large gear 96 driving the lower pinch roll 46 is operatively driven by the idler gear 100 on idler shaft 101 as shown in FIG. 4. The idler gear 100 is driven by the input shaft 28 by means of the chain of gears as described and said gear meshes with and drives gear 96 which in turn meshes with and drives the large gear 102 on shaft 70. The said shaft is connected by the offset radial drive coupling 58 with its upper pinch roll 45. The special coupling permits up and down bodily movement of the pinch roll.

Similar gearing structure is shown in FIG. 5 for driving the pinch rolls 47 and 48 at the exit end of the machine. The lower straightening roll shaft 106 journalled in the side walls 31 and 32 by the bearings 107 carries the gear 108 which meshes with the idler gear 110 on the idler shaft 111. Said ilder shaft is journalled by the bearing units 112 and 113, and as described with respect to the other idler shafts, the same has a second gear 114 thereon of the same size as 110. Two idential gears may be mounted on shaft 111 or one gear divided by the groove 80. The second idler gear 114 meshes with and drives the large gear 115 on the shaft 116 for driving the lower straightening roll 48. The bearings 117 and 118 journal shaft 116 in the walls 31 and 32, the said journalling units being retained by the cap plates 120. The large gear 115 meshes with and drives gear 121 on shaft 122, FIG. 4, and thus the upper pinch roll 47 is driven since shaft 122 has a coupling such as 58 connecting the same to the upper movable pinch roll 47. The structure is the same as described with respect to the upper pinch roll 45 and its driving gear 102.

It will be observed from FIG. 5 that both gears 110 and 114 on the idler shaft 111 have meshing reation with the large gear 115. This is a feature of the present invention having been devised to improve the driving relation between the idler gears and the large gears driving the pinch rolls. Also by having the large gears 96 and 115 mesh with both their driving idler gears any metal from the gear teeth accumulating in the groove 80 will be worn away. The constant meshing of the gear teeth during operation will eventually cause some metal to flow into the groove. The tendency is a maximum at respective ends of the machine where the pinch rolls apply considerable pressure to the metal strip and where the large gears are driven by smaller ilder gears. The wide teeth on the large gear 96 and also on the large gear 115 overlap the groove 80 in their driving idler gears so any metal such as may accumulate in grooves 80 is worn away.

For operation of the machine shown in FIGS. 1, 2 and 3, it is first necessary to thread the machine with the strip material which requires that the air bags 57 be deflated allowing the coil springs 56 to take over an elevate the upper movable pinch rolls 45 and 47. After the strip has been inserted through the entrance end of the machine, through the rolls and then through the pinch rolls at the exit end, the air bags 57 are inflated so as to apply the necessary pressure to the strip material between the pinch rolls. The motor 18 can now be energized to start the feeding operation and the hand wheels 73 can be actuated to lower the upper rolls 72 to start the straightening operation. As previously described, all the lower straightening rolls 44 will be rotated in the same direction by the overlapping gear drive and the lower rolls will also rotate at the same speed and in unison. The drive shafts have an operative connection to the rolls by means of the couplings 62, and the upper pinch rolls are connected to their driving gears by the special couplings 58 which are preferred over the universal joints and shafting of the type well known in the art.

For a full appreciation of the present overlapping gear drive it is necessary to understand that all the drive shafts journalled in the gear box such as 93, 82, 90 and 106 FIG. 4, and also those which have not been identified, are disposed in a stright line from end to end of the gear box. The center to center distance between adjacent drive shafts is the same. The invention is also unique as regards the idler shafts, 101, 85 and 111 having been identified. A pair of idler gears is mounted on each ilder shaft and the unit is interposed between adjacent drive shafts. Thus one ilder gear of each pair receives the drive in one plane and the other idler gear of each pair transmitts the drive in the other adjacent parallel plane.

I claim:

1. In feeding and straightening machines for strip material, the combination with a plurality of lower straightening rolls journalled for rotation in spaced walls provided by the straightening machine, a gear box located adjacent one side of the said machine and including side walls, an input drive shaft mounted for rotation in the walls of the gear box and having a pair of driving gears mounted thereon and located in the gear box, a plurality of drive gears for the lower straightening rolls and which are respectively mounted on a drive shaft journalled for rotation in the side walls of the gear box, certain drive gears being disposed to the right of the input drive shaft and having operative connection with one of the pair of driving gears on the input shaft, other drive gears being disposed to the left of the input drive shaft and having connection with the other driving gear on the input shaft, said gears both right and left of the input shaft having a staggered relation with certain drive gears being located in one plane and other drive gears being located in an adjacent parallel plane, whereby the drive gears may have pitch diameters greater than the center to center distance between adjacent drive shafts, a plurality of idler shafts journalled in the side walls of the gear box with each idler shaft having a pair of idler gears mounted on the same, one idler gear of each pair being disposed in one plane and receiving the drive from its drive gear which meshes therewith, the other idler gear of each pair being disposed in the other plane and transmitting the drive to an adjacent drive gear which likewise meshes therewith, and coupling means connecting each drive shaft with its respective lower straightening roll.

2. In feeding and straightening machines for strip material as defined by claim 1, wherein the pair of idler gears mounted on the idler shafts respectively comprises a single gear member having a central peripheral groove whereby to provide two gears in side by side relation.

3. In a feeding and straightening machine for strip material, the combination with a plurality of lower straightening rolls journalled for rotation in spaced walls provided by the said machine, of a plurality of drive gears for driving said lower straightening rolls, a gear box located adjacent one side of the straightening machine and including side walls, a plurality of drive shafts respectively journalled in the side walls of the gear box and each drive shaft having one of the drive gears mounted thereon and which is located within the gear box, the said drive within the gear box having a staggered relation so that certain gear lie in one plane and the other gears lie in an adjacent parallel plane, whereby the drive gears may have pitch diameters greater than the center to center distance between adjacent drive shafts, a plurality of idler shafts journalled by the side walls of the gear box, each idler shaft having a pair of idler gears mounted thereon and which are located between adjacent drive gears, whereby one idler gear of each pair receives the drive from an adjacent meshing drive gear and whereby the other idler gear of each pair transmits the drive to an adjacent drive gear which likewise meshes therewith.

4. A feeding and straightening machine as defined by claim 3, wherein the plurality of drive shafts journalled by the gear box are disposed in a straight line from end to end of the box, and whereby certain of the idler shafts also journalled by the gear box are located above the straight line with the remaining being located below the straight line.

5. In a feeding and straightening machine for strip material, the combination with a plurality of lower straightening rolls journalled for rotation in spaced side walls provided by the straightening machine, of a plurality of driving gears for driving said straightening rolls, said driving gears being respectively mounted on a drive shaft journalled for rotation in the side walls of a gear box, said gears within the gear box having staggered relation with certain gears lying in one plane and other gears lying in an adjacent, parallel plane, said gears having pitch diameters greater than the center to center distance between adjacent drive shafts, a pair of idler gears mounted on a shaft common to both and interposed between adjacent driving gears so that one idler gear of each pair lies in one plane and meshes with a driving gear in that plane with the other idler gear of each pair lying in the adjacent, parallel plane, and meshing with another driving gear in said last mentioned plane.

6. A feeding and straightening machine for strip material as defined by claim 5, wherein the idler gear shafts are journalled for rotation in the side walls of the gear box, and wherein one idler gear receives the drive from the driving gear meshing therewith, and wherein the other idler gear transmitts the drive to the drive gear in the adjacent, parallel plane having meshing relation therewith.

* * * * *